United States Patent [19]

Woog

[11] Patent Number: 5,017,273

[45] **Date of Patent: * May 21, 1991**

[54] DISPOSABLE CELL FOR RECOVERING CONDUCTIVE METAL AND METHOD OF USING

[76] Inventor: Gunter Woog, 5435 Bauers Dr., West Bend, Wis. 53095

[ * ] Notice: The portion of the term of this patent subsequent to May 30, 2006 has been disclaimed.

[21] Appl. No.: 327,998

[22] Filed: Mar. 23, 1989

Related U.S. Application Data

[63] Continuation-in-part of Ser. No. 07(1)208,767, Jun. 20, 1988, abandoned.

[51] Int. Cl.[5] ..... C25C 1/00

[52] U.S. Cl. ..... 204/105 R; 204/109; 204/237; 204/275

[58] Field of Search ..... 75/417; 204/105 R, 109, 204/237, 275

[56] References Cited

U.S. PATENT DOCUMENTS 4,802,961 2/1989 Woog et al. ..... 204/237
4,834,849 5/1989 Woog ..... 75/417

*Primary Examiner*—Melvyn J. Andrews
*Attorney, Agent, or Firm*—Fuller, Ryan & Hohenfeldt

[57] ABSTRACT

An method and apparatus for recovering a conductive metal from solution. The apparatus includes a first container for holding the solution, and a second container placed in liquid communication with the first container, a first electrode placed within the second container, and a second electrode composed of a thin film applied to the inside surface of the second container. The film may include as its main constituent the same metal as that to be recovered from solution. During the reaction, solution is circulated from the first container into the second container and back. A power supply is connected, positive to the first electrode and negative to the second electrode, causing the metal from the solution to be deposited on the second electrode, lining the inside surface of the second container with the metal to be recovered. Because the second container is constructed of material which will not contaminate the metal during smelting, on completion of the metal recovery operation, the entire second container is placed in a smelting furnace, eliminating the messy and wasteful step of removing the recovered metal from the cathode prior to smelting. In one embodiment the second container is mounted above the first container, and the first electrode may be tubular to be used as part of the return of the solution to the first container. In another embodiment the pump employed in the circulation step is the existing pump of a film processing machine.

21 Claims, 3 Drawing Sheets

DISPOSABLE CELL FOR RECOVERING CONDUCTIVE METAL AND METHOD OF USING

CROSS-REFERENCE TO RELATED APPLICATION

This application is a continuation-in-part of a copending application, U.S. Ser. No. 208,767, filed on June 20, 1988, now abandoned.

BACKGROUND OF THE INVENTION

This invention relates to methods and apparatus for recovering metals from liquid solutions, and in particular to methods and apparatus facilitating to recovery of silver from bleach fix solutions used in photo processing, by disposable cells, at high speed and with high efficiency.

Up to the present time, recovery of conductive metals from solution, and particularly recovery of silver from fixer solutions, has been a relatively expensive process, requiring substantial mechanism and moving parts, as well as close supervision or complex computer controls, to accomplish. This is because the recovery process is electrolytic in nature, and the reaction if not closely monitored can cause sulfiding, damage to the solution and loss of silver. Hence continuous agitation is required as well as close control of the current being supplied to the reaction.

For instance, X-Rite Company offers a number of silver recovery systems, all of which include some type of device provided specifically for agitating the solution. Further, most of the systems offered by X-Rite have a cathode which is coiled, thus having a relatively small surface area.

Similarly, Roconex Corporation manufactures a number of lines of silver recovery systems and markets them under the "Rotex" trademark. All of these systems include some devices specifically devoted to agitation, generally with a rotating cathode which must then be removed from the recovery unit and cleaned, and later reinstalled and reused.

Moreover, all of the systems referred to above are relatively expensive, and there is a need in the marketplace for systems which are less expensive and mechanically simpler, since mechanical simplicity brings with it a high degree of reliability. However, there are also systems that do not provide any agitation, in order to provide the ultimate in simplicity. Since these non-agitating systems may be too slow, some simple means for agitating the solution is called for in a disposable cell recovery process.

This invention relates to improvements to the apparatus described above and to solutions to some of the problems raised thereby.

SUMMARY OF THE INVENTION

The invention relates to an apparatus for recovering a conductive metal from a liquid which contains that metal in solution, and to a method for employing that apparatus to recover that metal. The invention is particularly well suited for recovery of silver from photographic fixer solutions. The apparatus includes a first container for holding the solution. A second, generally closed, non-metallic container is placed in liquid communication with the first container. A first electrode is mounted so as to be in physical contact with the solution within the second container. In one embodiment, the second container is placed on top of the first, and the first electrode is tubular to also provide liquid communication between the two containers. If the first electrode is not tubular, then other means for liquid communication between the two containers must be provided. A second electrode is composed of a thin conductive film applied to the inside surface of the second container. In the most preferred embodiment the film includes as its main constituent the same metal as that to be recovered from the solution. A power supply is electrically connected to the electrodes so as to result in the first electrode being an anode and the second electrode being a cathode, thus causing the metal from the solution to be deposited on the second, film electrode, lining the inside surface of the second container with the recovered metal.

The invention further includes a pump for circulating the metal laden liquid, that is, liquid containing the metal in solution, into the second container. In one embodiment, the pump relied upon is the recirculating pump from the film processing machine solution tank, and that tank itself is the first container.

In another embodiment, a separate pump and container are supplied. In that embodiment, the second container mounted on the top of the first container, and recovered solution drains down from the second container via the liquid communication means. The pump therefore has an inlet in the first container and an outlet in the second container. In either embodiment, the pump outlet is positioned within the second container so as to provide sufficient agitation of the solution in the second container merely by the discharge of solution therefrom.

The recovery operation is further facilitated by the fact that the metal recovered thereby is not required to be removed from the cathode, because the second container itself is disposable, constructed from materials such as plastic or glass which can be added to the smelting furnace without contaminating the smelting operation.

The method of the invention includes providing a first container for holding metal-carrying solution. A thin film of conductive material, such as the metal to be recovered, is applied to the inside surface of a second, disposable, electrically insulating container. An electrode is affixed in relation to the second container so that it protrudes at least partially therein and is insulated from the metal film on the inside surface of the second container. The second container is then connected to the first container so that there is fluid communication between the two containers. The solution from the first container is circulated into the second container in such a way as to cause substantial agitation of the solution therein. The voltage potential of the electrode over that of the thin film is then raised to about two volts, thereby causing the metal in the solution to be electrolytically deposited on the film and to build up thereon. This voltage and agitation causes rapid buildup of the metal on the film. When sufficient metal has been deposited on the film, the circulation is stopped and the solution is removed from the second container. Thereafter, the second container can be disconnected from the first container, the electrode can be removed from the second container and the entire second container can be placed in a smelting furnace for the smelting of the deposited metal.

Other objects and advantages of the invention will become apparent hereinafter.

DESCRIPTION OF THE PREFERRED EMBODIMENT

While the invention is applicable to removal of any type of conductive ionic metal in solution, it is particularly well suited to an application wherein silver is removed from photographic fixer or bleach-fix solutions. The following description will refer to that silver removal application as exemplary, but it should not be considered as limiting the intended scope of the invention.

Two-Container Embodiment

Figure 1:
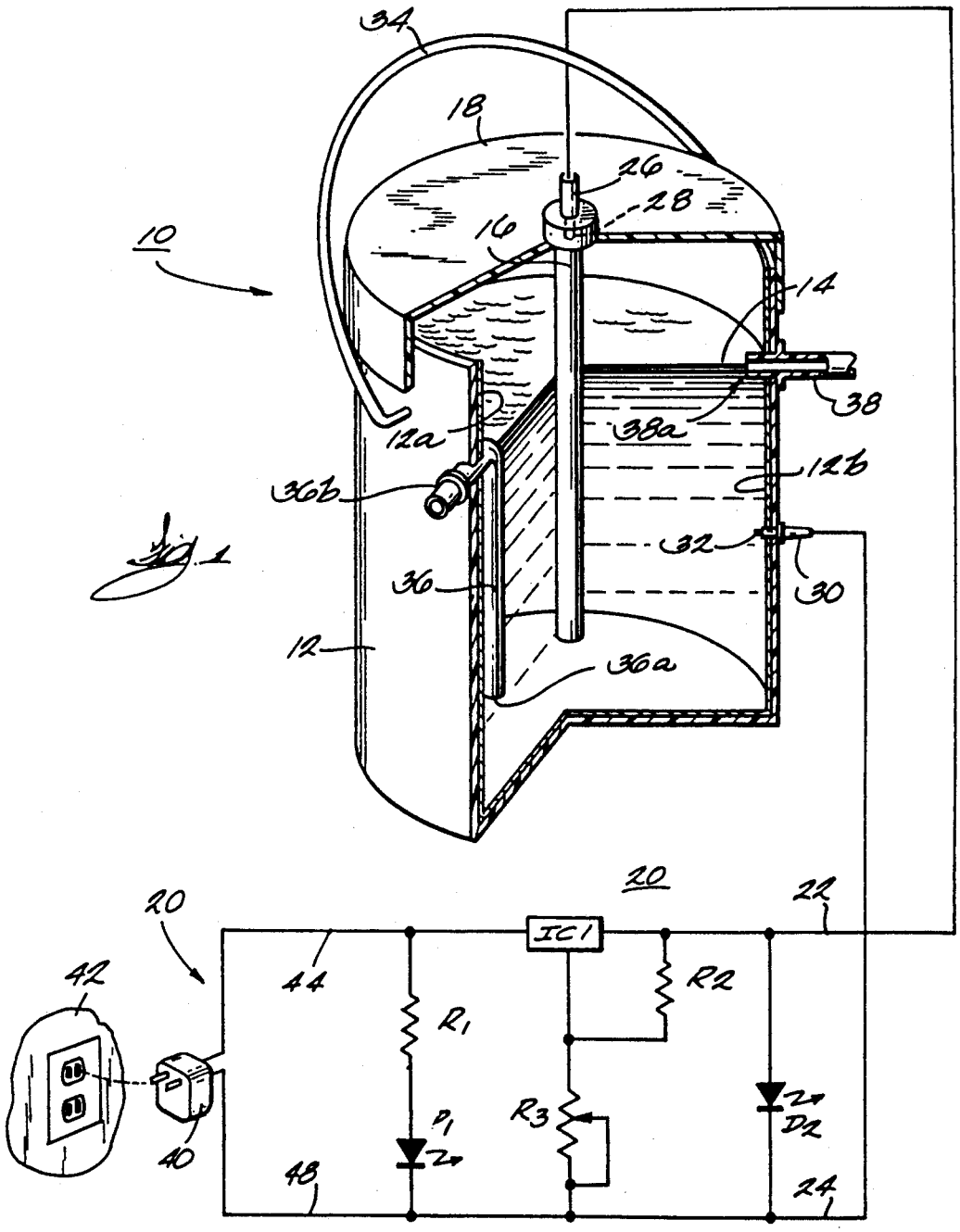
FIG. 1 is a sectional view, partially schematic, especially with respect to the electrical control circuit, of a metal recovery apparatus constructed according to one embodiment of the invention.

Referring now to FIG. 1, an apparatus 10 constructed according to one embodiment of the invention includes a first container 12, holding an amount of fixer solution 14. The fixer solution 14 is a solution in which ionic silver is dissolved in the present example. This solution may be circulated into and out of first container 12 by conventional means via an inlet 16 and an outlet 18, so as to make sure that the solution in the first container 12 at all times contains some dissolved silver. The top of first container 12 is covered by a suitable cover 20.

The apparatus 10 of the invention further includes a cell or second container 22, constructed of a material such as plastic or glass which is easily separated from the recovered silver during smelting. It may be advantageous that the second container 22 be constructed of a clear plastic or glass so as to allow the viewing of the progress of the deposition operation as will be described presently.

According to the invention, the entire inner surface **22*a* of second container 22 is coated with a very thin film 22*b* of conductive material. While that conductive metal may be any suitable metal which will not contaminate silver in the later process of smelting the silver, such as gold paint or stainless steel, in the preferred embodiment, silver, the metal to be recovered from the solution, is applied in a thin film such as by spray painting. If second container 22 is clear as indicated above, then just the side surface 22*a* should be covered, with the bottom surface 22*c*** left uncovered so as to allow observation of the progress of the plating operation within the second container.

The film **22*b* may be entirely the same as that described in U.S. Pat. No. 4,834,849 assigned to the assignee of the present application. As described there, the actual thickness of the film 22*b* as applied is not critical, as will be shown presently, as long as the interior surface 22*a* of the container 22 is evenly coated sufficiently thickly to conduct electricity. The thickness is commonly on the order of 1 mil. The material of the film, if sprayed on, may be generally any type of paint or other sprayable film containing substantial quantities of silver, such as Acrylic 1, Part No. 73-00025, from Tecknit EMI Shielding Products, or E-Kote 3040 from ACME Conductive Coatings. Alternatively, as indicated above, the film 22*b* may be some other conductive material. For instance, the film 22*b* may be a thin layer of stainless steel or gold, applied by means of tape or sheeting to the inside surface of second container 22**.

Figure 2:
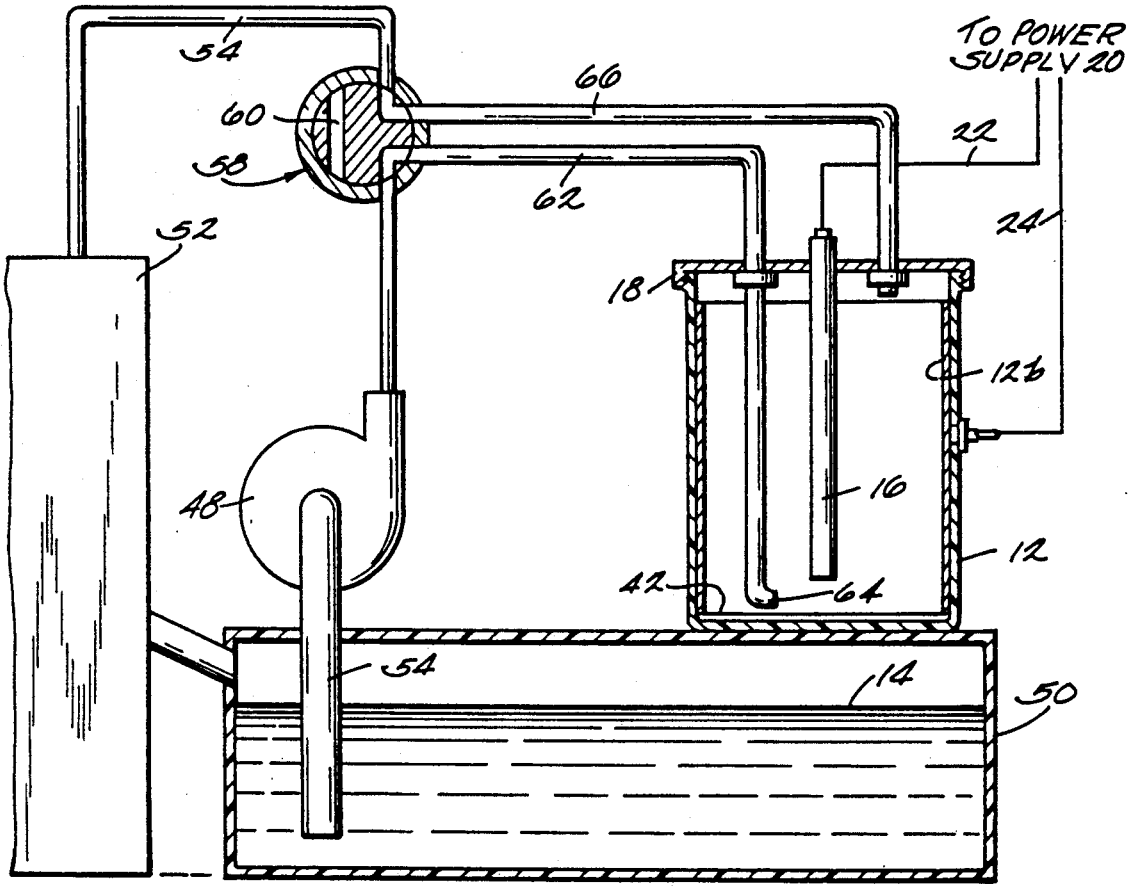
FIG. 2 is a sectional view, also partially schematic, of a metal recovery apparatus constructed according to an alternative embodiment of the invention.

Advantageously, second container 22 is provided with a cap 24, which is sized to fit in sealing engagement over the sole opening **22*d* of the second container. An electrode 26 is affixed near the center of the cap 24, for ease of assembly and mounting of the electrode 26 to the second container. Electrode 26 reaches substantially into the second container 22 for the majority of the length of the electrode, as shown in FIGS. 1 and 2, when the cap 24 is placed thereon. Electrode 26 may also, however, protrude slightly beyond cap 24, outside of second container 22. This electrode 26 can be formed of any suitable and readily available material for an electrode in such an application, such as stainless steel, since the solutions to be handled thereby can be corrosive. Preferably the cap 24 is formed of insulative material so as to insulate the electrode 26 from the thin film 22*b*. The cap 24 also includes an opening for a pump outlet 30, for reasons to be set forth presently. The second container 22 is then mounted on the first container 12 by inverting the second container and mounting the cap 24 onto the cover 20**, with the openings of the cap mating with similar openings provided for that purpose in the cover.

The apparatus 10 further includes a pump 28 for pumping the solution 14 from the first container up into the second container 22, via a pump outlet 30 positioned inside the second container. This pump outlet 30 is positioned so that the output of the pump 28 causes substantial agitation of the solution 14 within the second container 22. That is, the pump outlet 30 directs the solution 14 at an angle, so that the solution in second container 22 is agitated by the solution being pumped into the second container, merely by the force of the pump action. By this means, agitation of the solution 14 is provided without any apparatus devoted solely to the agitation function, resulting in a substantial economy of parts and mechanism, in turn improving the reliability and efficiency of the apparatus 10.

In the embodiment shown in FIG. 1, the second container 22 is inverted and placed on top of first container 12. The solution 14 pumped into the second container 22 is allowed to drain back into the first container 12 via up to two routes. The first route is a higher volume route, and must at least equal the flow of the pump outlet 30. As shown in FIG. 1, electrode 26 can be provided in a tubular configuration, to provide the necessary liquid communication means. Alternatively, electrode 26 could be solid and a separate liquid return tube 27 (in phantom) provided. In either case, the topmost opening **26*a* of electrode 26 or the separate liquid return tube 27 inside second container 22 is substantially above cap 24 when the second container is in its installed, inverted position, a substantial amount of solution 14 remains in second container 22, as shown in the figure. The level of the solution 14 within second container 22 is, thus, determined by the location of opening 26*a* of electrode 26, or the separate liquid return tube 27, above the opening of the second container. The second route by which solution drains back into first container 12 is via a drain opening 32 formed in the cap 24 and the cover 20. This drain opening 32 is always open, but the amount of the flow allowed by this drain opening is substantially less than the output of the pump 28. The purpose of drain opening 32 is to allow the solution 14 remaining in second container 22 after pump 28 is turned off to drain back into first container 12**, thereby preventing the recovered metal from redissolving back into the solution. Hence this apparatus has particular application to recovery of silver from bleach fix solutions used in photo processing, since this type of solution is particularly susceptible to re-dissolution when power is not applied.

The apparatus 10 further includes a power supply 34 for providing energy for an electrolytic reaction to plate the ionic silver out of the fixer solution 14. This power supply 34 is preferably on the order of less than two volts DC, having a positive lead 36 electrically connected to electrode 26 and a negative lead 38 electrically connected to the thin film **22*b* coating the inside surface 22*a* of second container 22. Hence the electrode 26, being connected to the positive lead of the power supply 34, is the anode for the electrolytic reaction, while the thin film 22*b*** in effect acts as another electrode, becoming the cathode for the electrolytic reaction because of its connection to the negative lead of the power supply.

In operation, an amount of solution 14 is placed in first container 12, which has already been closed by cover 20, pump 28 having previously been placed in the first container 12 with pump outlet 30 protruding through the top of the cover. The cap 24 carrying tubular electrode 26 is then installed on the second container 22, and that assembly is placed, inverted, on top of the cover 20, with the pump outlet 30 reaching just into the second container and the electrode reaching just into first container 12. Pump 28 is then turned on and electrode 26 and film **22*b* are connected to the power supply 34, and the metal recovery reaction begins. During the reaction, silver from the solution 14 is deposited on the silver film 22*b* until a suitable amount of the silver is deposited thereon. As the silver builds up on the film 22*b*, the cathode in effect increases in thickness. This is the reason that the original thickness of the film 22*b* is not critical, since it increases as the reaction progresses. Because of the relatively large surface area of the cathode film. 22*b* with respect to the amount of solution 14 contained in the second container, and because of the agitation provided by the solution entering at pump outlet 30, the metal will plate onto the cathode quickly, making the metal recovery operation very fast, even with the relatively low voltage from the power supply as indicated above. At this low voltage, current density is intended to be maintained in the area of 100 milliamperes per square inch, which is sufficient to quickly plate the metal onto the cathode. Since this is a "terminal" type recovery unit, and because of the agitation provided by the inlet, and because the solution is intended to be a bleach fix solution, damage to the solution is less of a concern that with most prior art systems, so that the current density need not be as low, or low current density is not as critical, as in a system where the chemical is to be recirculated, as is the case with the embodiment in FIG. 2**.

When a sufficient amount of silver has plated onto the cathode **22*b*, pump 28 may be turned off and power supply 34 disconnected. The solution remaining in second container 22 will drain back into first container 12 via drain opening 32. The second container 22 is then removed from the first container 12. If second container 22 is constructed of clear plastic as referred to above, the viewing of the progress of the plating on the film 22*b*, and the viewing of the draining of the solution 14 after the pump 28** is turned off, is facilitated.

Single Container Embodiment

FIG. 2 shows an alternative embodiment of the invention, wherein there is no separate first container corresponding to the first container 12 of the embodiment shown in FIG. 1. Rather, a plating container 40 is provided with a conductive film coating 42 about the inside surface thereof. This film 42 may be of the same material as the film **22*b* referred to above with respect to the embodiment shown in FIG. 1**.

In the embodiment shown in FIG. 2, the plating container 40 is in liquid communication with an existing, conventional, film processing machine solution tank 44, which is normally connected to a film processing machine 46 via a recirculating pump 48 and appropriate tubing 50, 52 and 54. In general, tank 44 serves as a holding tank for the film processing solution 56, which is continually recirculated to the film processing machine 46 by pump 48. This solution 56 builds up silver content with use, however, so that it has been conventional procedure to periodically replace the solution, and try to recover the silver therefrom because of the intrinsic value of the silver. The advantage of the embodiment shown in FIG. 2 is that the solution does not need to be replaced, at least not as often, if the silver can be removed and recovered from the solution 56 without removal or replacement of the solution, by use of the apparatus shown there.

The embodiment includes valve means 58 for, in one position, permitting normal flow of solution 56 from the pump 48 to the film processing machine 46, while in the other position diverting the flow to plating container 40. While one valve 60 is shown to accomplish the function of valve means 58, the same effect can be achieved by use of a plurality of valves. Valve means 58 includes one outlet **58*a* to which is attached an inlet 62 of the plating container 40. This inlet 62 terminates inside the container 40, at the bottom thereof, in a deflecting means 64. Thus when the valve means 58 is in its "divert" position, solution 56 is pumped by pump 48 into container 40, where deflecting means 64 deflects the flow of the solution, causing substantial and desirable agitation. The solution then returns to tubing 50 via an outlet 66, preferably connected to valve means 58**.

As is the case with the embodiment shown in FIG. 1, the embodiment shown in FIG. 2 is provided with an electrode 68 generally in the interior of the container 40, and with electrical connections 70 to the electrode 68 and the film 42 so that the potential of the electrode is raised over that of the film. Preferably that potential difference is less than two volts DC. Thus electrode 68 is made an anode and film 42 a cathode, resulting in silver being deposited on the film by an electroplating reaction. Again, because of the low current density, any damage to the solution in the recovery process is minimized. In the case of the embodiment shown in FIG. 2, this reduced current density is preferably in the area of 10 to 20 milliamperes per square inch. This of course is lower than that for the embodiment shown in FIG. 1. Part of the reason for the reduced current density is that the solution intended to be used with this embodiment is recirculated back into the photo processing machine, so that avoidance of damage to the solution is more critical than with the other embodiment. With this low level of current density, use of conventional chemicals may be reduced by as much as one-half or more. Chemical use may possibly be reduced even more with the use of specially designed chemicals.

Advantageously, the container 40 may be provided with a cover or cap 72, having means for holding inlet 62, outlet 66 and electrode 68. By use of such a cap 72, easy and quick substitution of different containers 40 is facilitated, so that silver recovery need only be interrupted for a short period for this substitution.

Similar to the second container 22 of FIG. 1, the plating container 40 of FIG. 2 is constructed of a material such as plastic or glass which is easily separated from the recovered silver during smelting. It may also be advantageous that plating container 40 be constructed of a clear plastic or glass so as to allow the viewing of the progress of the plating operation. This embodiment has the advantage of extremely low cost combined with fast plating operation, since agitation is provided by the existing recirculating pump 48 of the film processing machine 46, eliminating the need for a separate pump solely for the purpose of moving the solution 56 into the container 40 to be recovered.

In either embodiment, then, the used container 22 or 40 may then be placed in its entirety, after removal or disconnection from the respective apparatus, in a silver smelting furnace (not shown) to refine the silver for reuse. In most presently existing silver recovery devices, the deposited silver must be somehow removed from the cathode before smelting, whether by scraping or some other physical means or process. This can be a difficult, expensive and dangerous job. Moreover, some silver is inevitably lost in the process. The present invention provides a method and apparatus for recovering silver from fixer or bleach-fix solutions which is fast, clean and easy.

While the apparatus hereinbefore set forth is effectively adapted to fulfill the aforesaid objects, it is to be understood that the invention is not intended to be limited to the specific preferred embodiment of disposable cell for recovering conductive metal and method of using set forth above. Rather, it is to be taken as including all reasonable equivalents within the scope of the following claims.

I claim:

1. An apparatus for recovering a conductive metal from a liquid containing said metal in solution, said apparatus comprising:

a first container for containing an amount of said liquid;

a second container defining a cavity, in liquid communication with said first container and constructed of a material which is easily removed from said metal by smelting;

a first electrode removably affixed partially within said cavity;

a second electrode comprising a thin film applied to the inside surface of said container;

a pump having an outlet in said second container, for pumping said liquid from said first container into said second container, said liquid returning to said first container via return means; and a power supply electrically connected to said electrodes in such a way as to result in said first electrode being an anode and said second electrode being a cathode, thus causing said metal to be deposited on said second electrode.

2. An apparatus as recited in claim 1 wherein said second container is mounted above said first container, and wherein said first electrode comprises a tube connecting said cavity with said first container.

3. An apparatus as recited in claim 1 wherein said second electrode includes said metal to be recovered.

4. An apparatus as recited in claim 2 wherein said pump is positioned within said first container, and has an outlet in said second container, for pumping said liquid from said first container into said second container, said liquid returning to said first container via said tube of said first electrode.

5. An apparatus as recited in claim 4 wherein said pump has a predefined capacity, and further comprising a drain for allowing said liquid to drain back into said first container from said second container when said pump is not running, said drain having a flow rate substantially less than the capacity of said pump.

6. An apparatus as recited in claim 2 wherein said second container is substantially smaller than said first container.

7. An apparatus as recited in claim 1 wherein said pump outlet is positioned to cause substantial agitation of said liquid within said cavity.

8. An apparatus as recited in claim 1 wherein said pump is an existing pump of a film processing machine, and wherein said first container is a solution tank of a film processing machine.

9. A disposable cell for recovering a conductive metal from a solution containing said conductive metal, for connecting to a container containing said solution and a solution pump with an inlet positioned within said container, said cell comprising:

a disposable insulative jar, constructed of a material which is easily removed from said conductive metal by smelting, having a thin film of conductive material applied to the interior thereof, an outlet of said pump being positioned within said jar;

an electrode removably affixed partially within said jar, formed of electrically conductive material;

a power supply having two poles, a positive pole and a negative pole, said positive pole being electrically connected to said electrode and said negative pole being electrically connected to said thin film, such that said metal is deposited on said thin film as it is recovered and, after recovery is sufficiently complete, said power supply and said electrode can be removed and the balance of the cell can be placed in a smelting furnace in its entirety, without further disassembly and without prior removal of said recovered metal from said jar.

10. A cell as recited in claim 9 wherein said pump is an existing pump of a film processing machine, and wherein said first container is a solution tank of a film processing machine.

11. A cell as recited in claim 9 wherein said jar is mounted on top of said container, and wherein said pump has a predefined capacity, and further comprising a drain for allowing said liquid to drain back into said container from said jar, said drain having a flow rate less than the capacity of said pump.

12. An apparatus as recited in claim 9 wherein said jar is substantially smaller than said container.

13. An apparatus as recited in claim 9 wherein said pump outlet is positioned to cause substantial agitation of said liquid within said jar.

14. A method for recovering a conductive metal from a solution containing said metal, comprising the steps of:

providing a first container for containing said solution;

applying a thin film of said metal to the inside surface of a second container;

removably affixing an electrode partially within said second container;

placing said second container in liquid communication with said first container;

circulating said liquid from said first container into said second container and back;

raising the voltage potential of said electrode over that of said thin film, thereby causing said metal in said solution to be deposited on said film and to build up thereon.

15. A method as recited in claim 14 wherein said first container is a solution tank of a film processing machine.

16. A method as recited in claim 14 wherein said electrode is tubular and constructed of a conductive metal different from the metal to be recovered from said solution.

17. A method as recited in claim 14 wherein said first electrode is tubular and further comprising positioning said second container, opening down, above said first container such that said first electrode is in fluid communication with both containers; and permitting said solution to return to said first container via said first electrode after the level of the liquid in said second container has reached a predetermined level.

18. A method as recited in claim 14 wherein said circulating is done at a circulating flow rate, and further comprising the step of preventing the collected metal from being re-dissolved into the solution, by allowing said solution to constantly drain from said second container into said first container at a rate substantially lower than said circulating flow rate.

19. A method as recited in claim 14 further comprising the step of agitating the solution in said second container.

20. A method as recited in claim 19 wherein said agitation step is accomplished by directing said circulating within said second container so as to cause agitation within said second container.

21. A method as recited in claim 14 further comprising the steps of:

disconnecting said second container from said first container;

removing said electrode from said second container, and placing said second container, including said deposited metal, in a smelting furnace and smelting said metal.

* * * * *

UNITED STATES PATENT AND TRADEMARK OFFICE

CERTIFICATE OF CORRECTION

PATENT NO. : 5,017,273

DATED : May 21, 1991

INVENTOR(S) : Gunter Woog

It is certified that error appears in the above-identified patent and that said Letters Patent is hereby corrected as shown below:

Columns 9 and 10, lines 27; 1 and 2, respectively:

Delete "after the level of the liquid in said second container has reached a predetermined level".

Signed and Sealed this

Eighth Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,017,273

DATED : May 21, 1991

INVENTOR(S) : Gunter Woog

Figure 3:
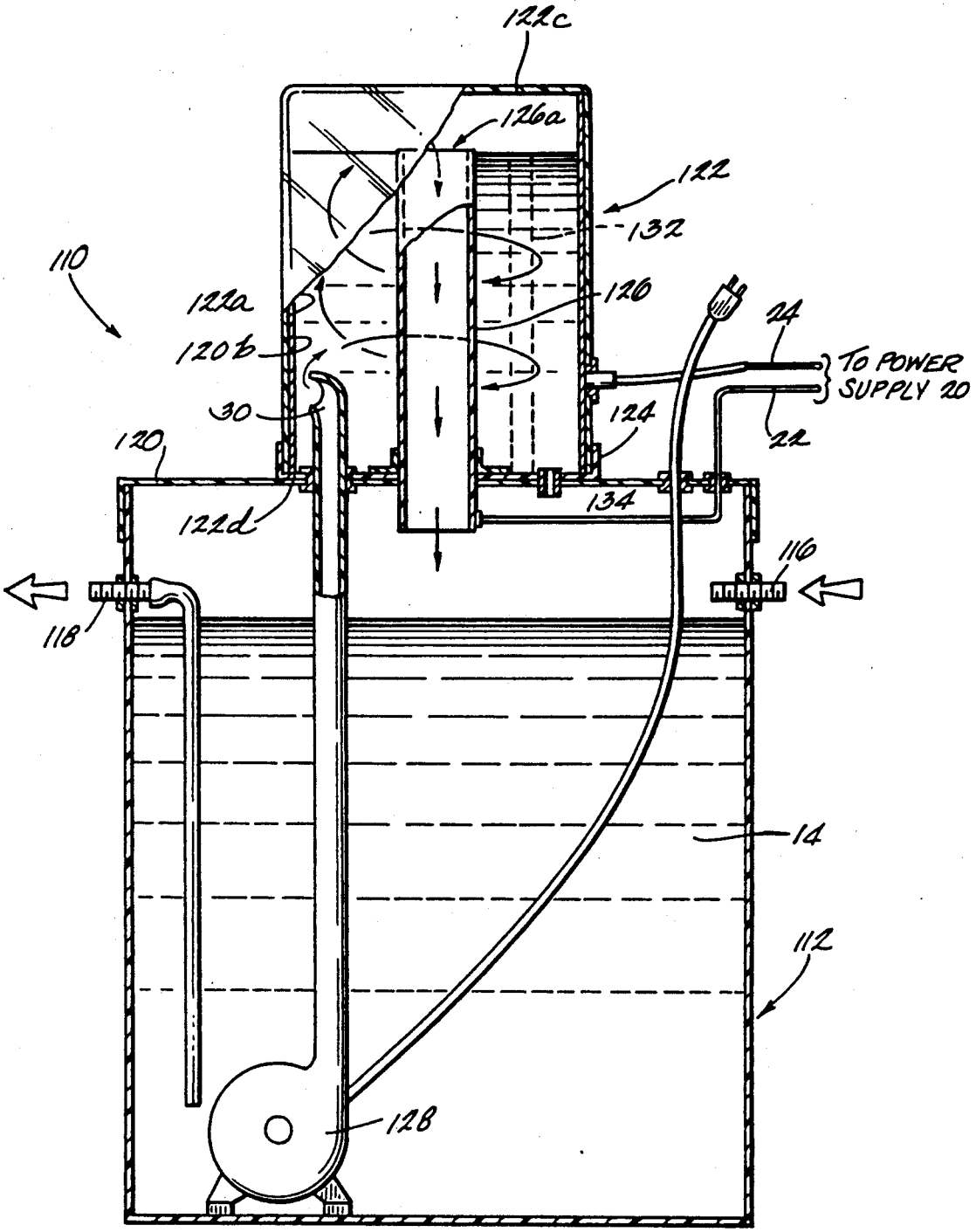
Figure 1:
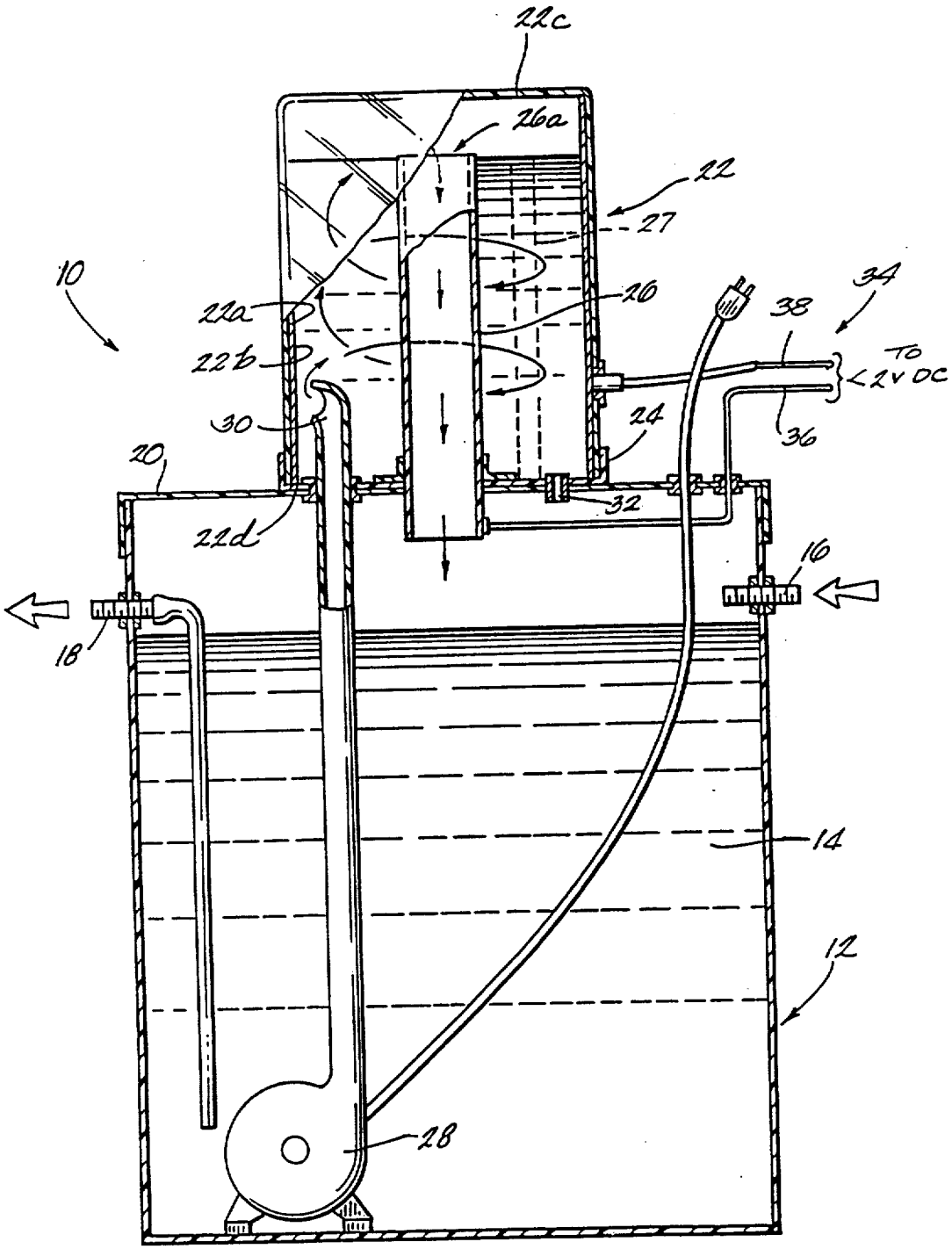
Figure 2:
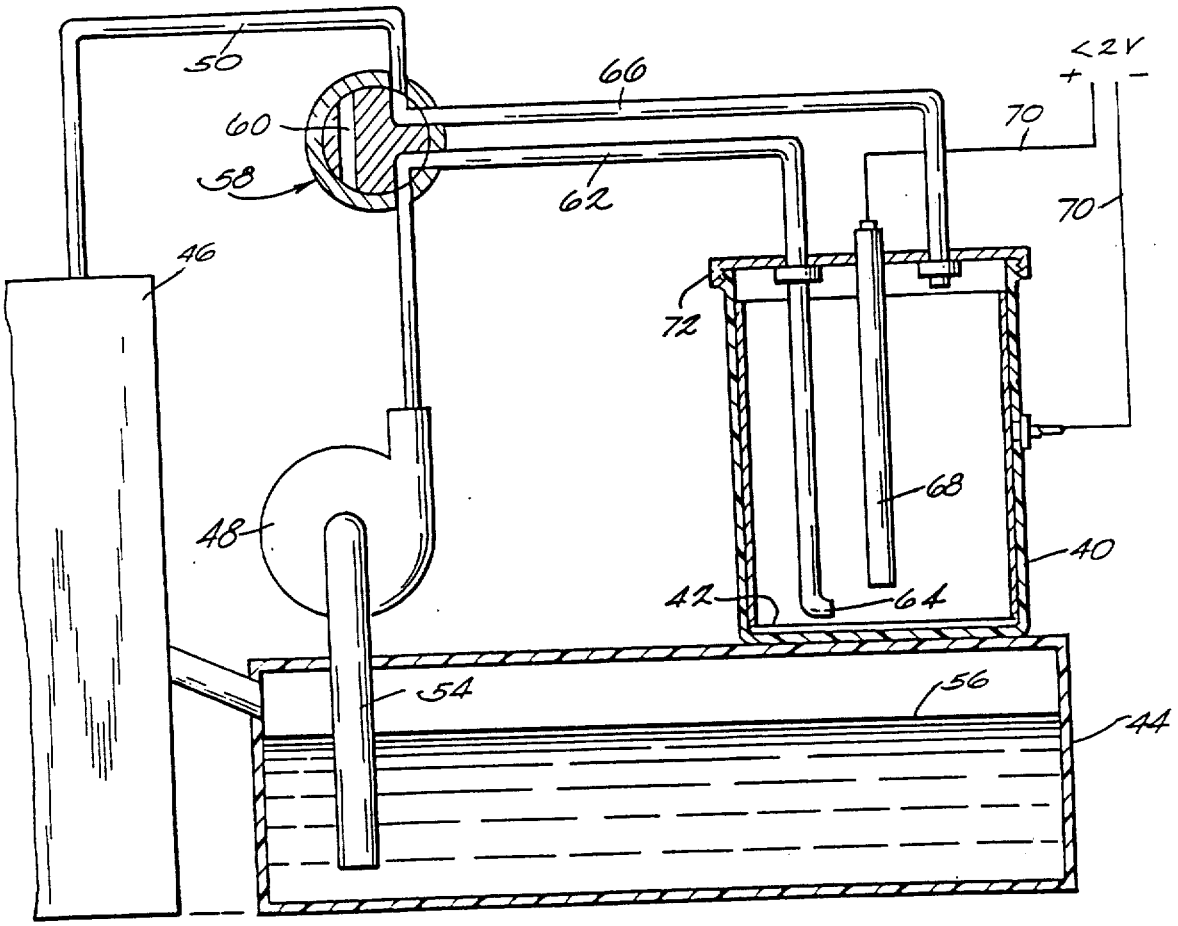

It is certified that error appears in the above-indentified patent and that said Letters Patent is hereby corrected as shown below:

The title page, should be deleted to be replaced with the attached title page:

The drawing sheet, consisting of Figs.1,2,and 3, should be deleted to be replaced with the drawing sheet, consisting of Fig. 1, 2, as shown on the attached page.

Signed and Sealed this

Sixth Day of September, 1994

*Attest:*

Bruce Lehman

BRUCE LEHMAN

*Attesting Officer*

*Commissioner of Patents and Trademarks*

United States Patent [19]

Woog

[11] Patent Number: 5,017,273

[45] Date of Patent: * May 21, 1991

[54] DISPOSABLE CELL FOR RECOVERING CONDUCTIVE METAL AND METHOD OF USING

[76] Inventor: Gunter Woog, 5435 Bauers Dr., West Bend, Wis. 53095

[ * ] Notice: The portion of the term of this patent subsequent to May 30, 2006 has been disclaimed.

[21] Appl. No.: 327,998

[22] Filed: Mar. 23, 1989

Related U.S. Application Data

[63] Continuation-in-part of Ser. No. 07(1)208,767, Jun. 20, 1988, abandoned.

[51] Int. Cl.[5] ..... C25C 1/00

[52] U.S. Cl. ..... 204/105 R; 204/109; 204/237; 204/275

[58] Field of Search ..... 75/417; 204/105 R, 109, 204/237, 275

[56] References Cited

U.S. PATENT DOCUMENTS 4,802,961 2/1989 Woog et al. ..... 204/237

4,834,849 5/1989 Woog ..... 75/417

*Primary Examiner*—Melvyn J. Andrews

*Attorney, Agent, or Firm*—Fuller, Ryan & Hohenfeldt

[57] ABSTRACT

An method and apparatus for recovering a conductive metal from solution. The apparatus includes a first container for holding the solution, and a second container placed in liquid communication with the first container, a first electrode placed within the second container, and a second electrode composed of a thin film applied to the inside surface of the second container. The film may include as its main constituent the same metal as that to be recovered from solution. During the reaction, solution is circulated from the first container into the second container and back. A power supply is connected, positive to the first electrode and negative to the second electrode, causing the metal from the solution to be deposited on the second electrode, lining the inside surface of the second container with the metal to be recovered. Because the second container is constructed of material which will not contaminate the metal during smelting, on completion of the metal recovery operation, the entire second container is placed in a smelting furnace, eliminating the messy and wasteful step of removing the recovered metal from the cathode prior to smelting. In one embodiment the second container is mounted above the first container, and the first electrode may be tubular to be used as part of the return of the solution to the first container. In another embodiment the pump employed in the circulation step is the existing pump of a film processing machine.

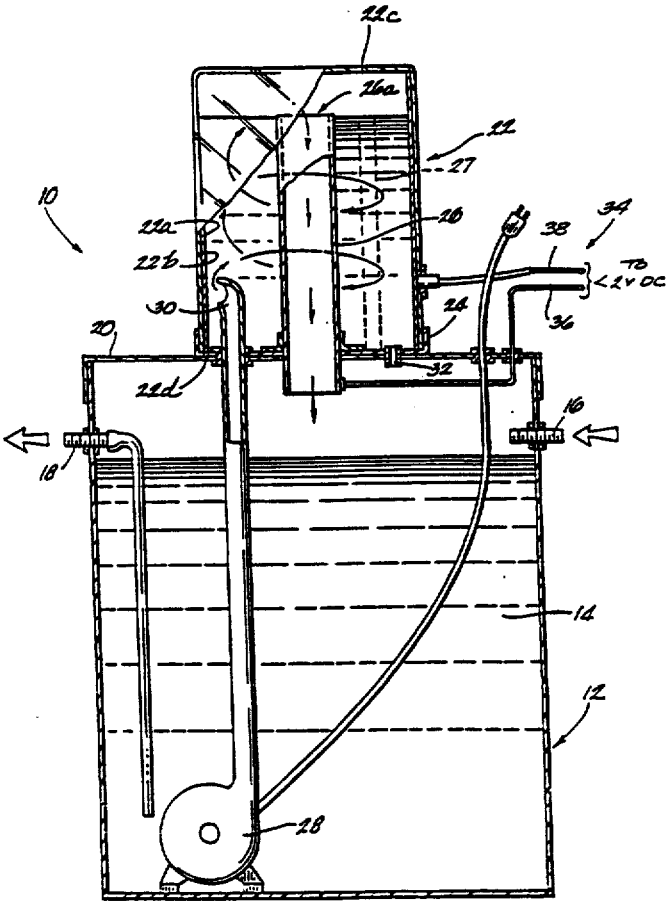

21 Claims, 3 Drawing Sheets